United States Patent [19]

Hutter

[11] Patent Number: 4,684,201

[45] Date of Patent: Aug. 4, 1987

[54] ONE-PIECE CRIMP-TYPE CONNECTOR AND METHOD FOR TERMINATING A COAXIAL CABLE

[75] Inventor: Harold G. Hutter, Brookfield, Conn.

[73] Assignee: Allied Corporation, Morris Township, Morris County, N.J.

[21] Appl. No.: 750,372

[22] Filed: Jun. 28, 1985

[51] Int. Cl.[4] ..... H01R 17/18

[52] U.S. Cl. ..... 439/585

[58] Field of Search ..... 339/177 R, 177 E, 143 R, 339/276 R, 14 R, 14 P, 94 C; 29/861, 862, 863

[56] References Cited

U.S. PATENT DOCUMENTS

| | | | |
|---|---|---|---|
| 2,673,233 | 3/1954 | Salisbury | 174/88 |
| 2,798,113 | 7/1957 | Koller et al. | 339/276 R |
| 2,941,028 | 6/1960 | Edlen et al. | 339/177 R |
| 2,983,895 | 5/1961 | Pasik | 339/276 R |
| 3,054,981 | 9/1962 | Malek | 339/177 |
| 3,107,135 | 10/1963 | Keil | 339/103 |
| 3,229,241 | 1/1966 | Kao | 339/177 |
| 3,281,756 | 10/1960 | O'Keefe et al. | 339/89 |
| 3,296,363 | 1/1967 | Laudig et al. | 174/89 |
| 3,406,373 | 10/1968 | Forney, Jr. | 339/177 R |
| 3,474,399 | 10/1969 | Teagno | 339/276 R |
| 3,644,874 | 2/1972 | Hutter | 339/89 C |
| 3,646,502 | 2/1972 | Hutter et al. | 339/89 C |
| 3,982,060 | 9/1976 | Avery et al. | 174/75 C |
| 4,305,638 | 12/1981 | Hutter | 339/177 R |
| 4,339,318 | 8/1983 | Waters | 174/35 C |

OTHER PUBLICATIONS

OG, vol. 1033/No. 4, p. 1472, issued Aug. 23, 1983, showing U.S. Pat. No. 4,400,050 "Fitting for Coaxial Cable" (Hayward).

OG, 1356, vol. 1054/No. 3, issued May 21, 1985, showing U.S. Pat. No. 4,518,819, "Clamp Assembly for Power Cables" (Larsson).

*Primary Examiner*—Gil Weidenfeld
*Assistant Examiner*—David Pirlot
*Attorney, Agent, or Firm*—C. D. Lacina; R. H. Criss

[57] ABSTRACT

A set of three annular ribs (44,46,48) disposed annularly around a crimp sleeve (28) are crimped radially inward about a coaxial cable (10) having a forward end portion (20) of its cable braid (16) exposed and folded backwardly, the ribs when crimped inwardly providing cable retention, electrical circuit path between the sleeve and braid, and in a moisture seal adjacent the rearward end face (38) of the sleeve.

2 Claims, 5 Drawing Figures

FIG. 1
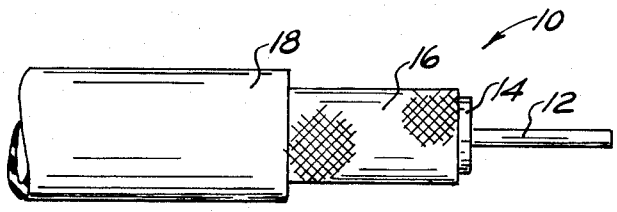
FIG. 2
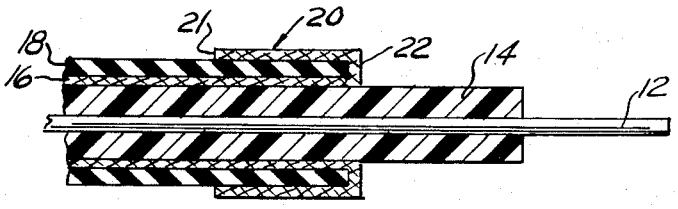
FIG. 3
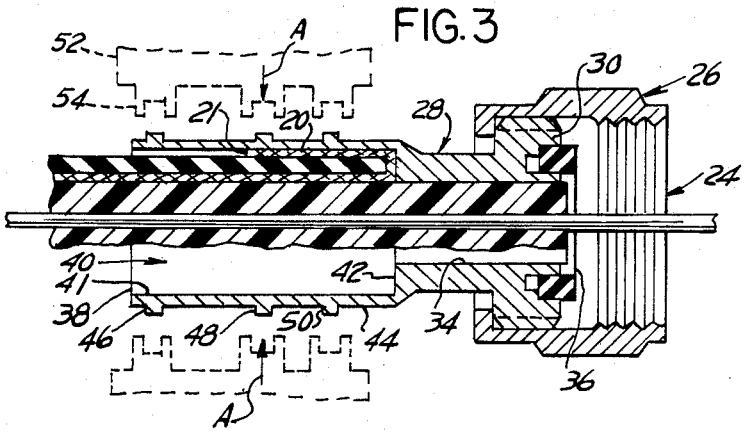
FIG. 5
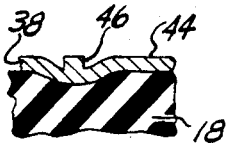
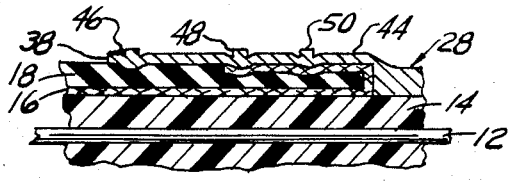
FIG. 4

ONE-PIECE CRIMP-TYPE CONNECTOR AND METHOD FOR TERMINATING A COAXIAL CABLE

This invention relates to a connector for terminating a coaxial cable and more particularly to a one-piece crimp-type sleeve for simultaneously clamping and moisture sealing a terminated cable.

Many electrical connectors for terminating coaxial cables of the type including an insulated inner conductor surrounded by a conductive braid shield and insulated jacket include a conductive cylindrical ferrule with the insulated conductor passing through the ferrule and the brain circumposing and engaging the ferrule. A crimp ring is then crimped radially inward about the jacket to secure the cable to the ferrule. It has been found that with this crimp design that the crimp joint could be poor and not reliable, the termination was not weather-proofed at the termination end of the ferrule, and additional parts were required for the assembly. This situation was found to be true whether the cross-section of the crimp ring was cylindrical or hexagonal.

It is a purpose of this invention to provide a termination for a coaxial cable of the type described which eliminates loose crimp joints and weather proofs the cable termination.

In accordance with these objects, this invention provides a connector member which includes a cylindrical sleeve having a stepped bore extending therethrough with a rearward internal diameter of the bore being larger than that of the forward end portion of the cable so as to define a cavity to receive the cable to be terminated. A set of three annular ribs extend radially outward from the outer periphery of the sleeve, each being adapted to be crimped radially inward about its respective cable portion by an amount generally measured by the outward radial extension of each rib. The first rib is adjacent to the rearward end face of the sleeve leading into the bore and the crimp provides moisture sealing protection and a gripping retention about the outer insulative jacket. The second rib circumposes a backward folded portion of the braid and its crimp completes a conductive path between the sleeve and the cable and provides a gripping retention. The third rib is adjacent the interior end wall of the sleeve and, like the second rib, provides another conductive path and gripping retention about the cable.

The cable forward end portion is prepared by exposing and folding rearwardly a portion of the braid conductor so as to surround part of the insulative outer jacket. The prepared end portion is inserted into the sleeve cavity so that the braid fold surface abuts against an interior end wall of the sleeve. The edge of the folded back braid is disposed between the first and the second ribs.

As a result, the one-piece crimp sleeve allows a user to utilize tools readily available and having a low cost, eliminates a need for additional pieces, and provides a moisture sealed entry around the cable adjacent to the cavity entry without additional sealing devices (e.g., O-rings, gaskets, etc.). As a result, the connector assembly is water-proofed, provided with excellent cable retention, and has high reliability crimp connection.

The foregoing and other objects, features and advantages of the invention will be apparent from the following description of the invention as illustrated in the accompanying drawings:

FIG. 1 is a side view of a coaxial cable being prepared for use.

FIG. 2 is a section view of the cable after further preparation.

FIG. 3 is the cable of FIG. 2 inserted into a connector.

FIG. 4 is a section view of a terminated connector assembly.

FIG. 5 is an enlarged view of a portion of FIG. 4.

Referring now to the drawing, FIG. 1 shows a coaxial-type cable 10 of the type comprising a center conductor 12 which is sucessively circumposed by a dielectric layer 14, an outer conductor 16 of braid (i.e., the shield), and an outer insulating jacket 18, the center and outer conductors each having a forward end portion exposed for termination in a connector member.

FIG. 2 shows the exposed forward end portion 20 of the braid conductor having been folded rearwardly back onto the cable by an amount sufficient to surround part of the insulating jacket 18 and expose part of the dielectric layer 14. An abutment face 22 is formed at that point (i.e., the bight) where the braid is folded.

FIG. 3 shows a connector member 24 comprising a cylindrical sleeve 28, a coupling ring 26 mounted for rotation about the sleeve, and a forward end portion of the prepared cable 10, positioned in the sleeve, the cable being partially cut-away and in section to show detail of the sleeve. The coupling ring is internally threaded for coupling with a mating connector element (not shown).

The sleeve 28 includes an enlarged forward section 30 which fits within the coupling ring, a rearward section 32 for terminating the cable, and an interior bore 34 which extends from a forward end face 36 to a rearward end face 38 thereof. The bore 34 is stepped and expands from a first diameter in the forward section 30 to a larger second diameter in the rearward section 32 an amount sufficient to define a cavity 40 sized to receive the forward end portion of the cable, the transition step in the bore defining an interior end wall 42 for the abutment 22 face of the braid to abut and define an inward limit for positioning the cable in the cavity. The cavity 40 is defined by a cylindrical wall 41 the diameter of which is slightly greater than that part of the cable where the braid is folded back whereby to receive the cable in a snug clearance fit.

Disposed at selected axial positions and extending annularly around the outer periphery 44 of the sleeve are three ribs 46, 48 and 50, the first rib 46 being disposed adjacent to the rearward end face 38, the second rib 48 being disposed centrally of the rearward section 32, and the third rib 50 being disposed proximate to the interior end wall 42 of the bore 34. As shown, the forward end portion 20 of the braid is folded back axially by an amount sufficient so that the braid has its edge 21 terminate between the location of the first and the second ribs. That is, the second (i.e., center) rib 48 is in circumposing relation about the rearward terminus of the backwardly folded cable braid.

Shown in dotted lines is a tool 52 comprising three inward jaw members 54, each jaw being registered with one respective rib. As a result of each jaw member being driven in the direction of the arrow "A", each rib is driven radially inward whereby the sleeve is locally compressed into engagement with the outer surface of the cable.

The ribs 46, 48 and 50 each extend radially outward from the outer periphery 44 of the sleeve by an amount which defines the inward compression. In particular, as result of the inward compression (or crimping) of the ribs, the surface defining the inner wall 41 of the cavity 40 and circumposed by the respective ribs deforms radially inward about the cable. The outer periphery of each rib, once the sleeve 28 is crimped, is generally coaxial with the outer periphery 44 of the undeformed sleeve between the ribs.

FIG. 4 shows a completed crimping. The first rib 46 is engaged with the outer insulator jacket, the second (i.e., center ) rib 48 is pressing down about the cable braid, and the third rib 50 is pressing down about the cable braid adjacent the end wall. The sleeve 28, so crimped, provides a gripping mechanical retention about the cable at three locations, two electrical circuit paths which will shield the center conductor, and a moisture seal. The first rib 46 grips the cable and moisture seals the area around the entrance to the cavity. The second and third rib, in addition to gripping the cable, also engage the braid conductor to complete a circuit path between the braid and sleeve. The braid end face 22, by abutting the end wall 42 of the cavity, also enhances the conductive path between the braid and sleeve.

FIG. 5 shows the sleeve 28 crimped about the cable end portion and enlarges detail of the deformed sleeve and the outer periphery of the first rib 46 relative to the outer periphery of the undeformed sleeve (to the right of the rib 46), this being typical for each of the three ribs.

What is claimed is:

1. A one-piece crimp-type connector terminated to a coaxial cable, said cable including a center conductor successively circumposed by a dielectric layer, an outer braid conductor, and an outer insulating jacket, and said connector comprising a conductive sleeve having an exterior end face, an interior end wall, an inner wall defining a bore for receiving an end portion of said cable, said bore extending between the end face and the end wall, and securing means engaging the end portion of said cable for securing the cable within said bore, characterized by a portion of the outer braid conductor being exposed and folded rearwardly an amount sufficient to surround part of the insulating jacket disposed in the bore with the braid fold forming a conductive bight for abutting the end wall, said sleeve being a one-piece member and the securing means comprising three continuous annular ribs arranged around the outer periphery of said sleeve each rib being crimped radially inward so that the inner wall circumposed by a first rib compressively engages the insulating jacket adjacent to the end face to grip said cable and to provide a moisture seal around the entrance of said cable to said bore, the inner wall circumposed by a second rib compressively engages the braid conductor against the insulating jacket to provide an electrical path between said braid conductor and said sleeve and to grip said cable, and the inner wall circumposed by a third rib compressively engages the outer braid conductor adjacent to said end wall to provide an additional electrical path between said braid conductor and said sleeve and to grip said cable.

2. The invention as recited in claim 1 wherein the ribs are crimped inwardly by an amount such that their outer periphery is substantially coaxial with the outer periphery of the sleeve medially of the ribs.

* * * * *